US008573592B2

(12) United States Patent
Prabhat

(10) Patent No.: US 8,573,592 B2
(45) Date of Patent: Nov. 5, 2013

(54) INLINE SKEW AND LATERAL MEASUREMENT OF A SHEET DURING PRINTING

(75) Inventor: Saurabh Prabhat, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 522 days.

(21) Appl. No.: 12/399,462

(22) Filed: Mar. 6, 2009

(65) Prior Publication Data

US 2010/0225051 A1 Sep. 9, 2010

(51) Int. Cl.
*B65H 7/02* (2006.01)

(52) U.S. Cl.
USPC ..... 271/227; 399/394; 399/395

(58) Field of Classification Search
USPC ..... 271/227; 399/394, 395; 358/462
See application file for complete search history.

(56) References Cited

U.S. PATENT DOCUMENTS

| | | | | |
|---|---|---|---|---|
| 4,367,045 | A * | 1/1983 | Grosvernier | 356/394 |
| 5,510,877 | A | 4/1996 | deJong et al. | |
| 5,887,996 | A * | 3/1999 | Castelli et al. | 400/579 |
| 6,195,518 | B1 | 2/2001 | Bennett et al. | |
| 6,895,210 | B1 * | 5/2005 | Quesnel | 399/395 |
| 6,904,255 | B2 | 6/2005 | Kera et al. | |
| 6,920,307 | B2 * | 7/2005 | Howe | 399/395 |
| 7,120,314 | B2 * | 10/2006 | Schweid et al. | 382/289 |
| 7,177,585 | B2 * | 2/2007 | Matsuzaka et al. | 399/394 |
| 7,184,153 | B2 * | 2/2007 | Leonhardt | 358/1.12 |
| 7,509,068 | B2 * | 3/2009 | Honma | 399/82 |
| 7,616,918 | B2 * | 11/2009 | Jeon | 399/301 |
| 2004/0251607 | A1 | 12/2004 | Mandel et al. | |
| 2006/0027271 | A1 | 2/2006 | Klipfel et al. | |
| 2006/0163801 | A1 | 7/2006 | Dejong et al. | |
| 2006/0261540 | A1 | 11/2006 | Loiselle et al. | |
| 2007/0065200 | A1 * | 3/2007 | Asaba | 399/394 |
| 2008/0095560 | A1 * | 4/2008 | Larson et al. | 399/394 |
| 2008/0193148 | A1 * | 8/2008 | Bonino | 399/15 |

FOREIGN PATENT DOCUMENTS

| | | | |
|---|---|---|---|
| DE | 44 01 900 | C2 | 9/1998 |
| EP | 1 445 664 | A2 | 11/2004 |

OTHER PUBLICATIONS

U.S. Appl. No. 12/371,110, filed Feb. 13, 2009, entitled Substrate Media Registration and De-Skew, Apparatus, Method and System.
U.S. Appl. No. 12/364,675, filed Feb. 3, 2009, entitled Modular Color Xerographic Printing Architecture.
U.S. Appl. No. 12/262,803, filed Oct. 31, 2008, entitled Method of and System for Module to Module Skew Alignment.

* cited by examiner

*Primary Examiner* — Kaitlin Joerger
*Assistant Examiner* — Ernesto Suarez
(74) *Attorney, Agent, or Firm* — Hoffmann & Baron, LLP

(57) ABSTRACT

According to aspects illustrated herein, there is provided a method and system for measuring and controlling an angular orientation of a printed sheet along a feed path of a print making device, the printed sheet being a sheet of paper with a paper edge moving along the feed path and an image printed thereon. The method includes the following steps. First, moving the printed sheet past at least one pair of optical sensors to determine a first skew of the paper edge with respect to a first fixed reference and a second skew of the image with respect to a second fixed reference. Then, combining the first skew and the second skew to determine the total skew between the paper edge and the image. Finally, correcting the total skew for subsequent sheets using the first skew and the second skew information. Similar steps can be taken to determine the lateral positioning errors which can then be corrected.

15 Claims, 4 Drawing Sheets

INLINE SKEW AND LATERAL MEASUREMENT OF A SHEET DURING PRINTING

INCORPORATION BY REFERENCE

The following US Patent Application is incorporated in its entirety for the teachings therein: U.S. Patent and Trademark Office application Ser. No. 12/364,675, filed Feb. 3, 2009, entitled MODULAR COLOR XEROGRAPHIC PRINTING ARCHITECTURE.

TECHNICAL FIELD

This disclosure generally relates to a method for determining an angular orientation and/or lateral positioning of an image on a sheet of printing material, and system for monitoring the angular orientation and/or lateral positioning of an image on a sheet of printing material.

BACKGROUND

For precisely positioning an image on a sheet of printing material, it is necessary to monitor, and if necessary or desirable, to correct the position of the image. The precise position of an image on the sheet of printing material may be important when, for example, the printed sheet is positioned on a feed path and being sent through a sheet-fed press that separately prints each color on the printed sheet; therefore, all colors must be precisely positioned to correctly print the image. While prior methods have been successful in identifying errors in the printing of images using a print making device, many prior methods perform error checking that is either expensive or use an offline or manual procedure. The offline procedures require the error checking to be completed after the image is printed, at which point only subsequent printing may be corrected.

For example, the published German Patent Document DE 44 01 900 C2, discloses a method for controlling the position of an image on a sheet in a sheet-fed printing press wherein the sheet is conveyed, printed, and monitored with respect to a deviation of the position of the image from sheet edges with regard to spacing and parallel position relative to a nominal or desired condition or phase. If necessary, suitable adjusting or positioning elements are manipulated, and the position of the image is thereby corrected. Performance of the method includes an image recording system arranged along the conveying path of the sheet, for obtaining image signals over the surface of the entire sheet. From the image signals, the spacing and the parallelism of the printing image to the paper edges of the sheet are derived, and deviations from nominal or set point values are determined. From the deviations, positioning signals for a corrective orientation of the image on the sheet are determined by the adjusting or positioning elements.

Since the entire surface of the sheet must be acquired by the image recording system in order to enable an evaluation of the position of the image on the sheet, the above method is expensive. Therefore, it would be advantageous to provide a less expensive method for correcting skew and lateral errors by identifying errors on the printed sheet and then adjusting the subsequent printed sheet and/or the print making device prior to printing.

SUMMARY

According to aspects illustrated herein, there is provided a method for measuring and controlling an angular orientation of a printed sheet along a feed path of a print making device, the printed sheet being a sheet of paper with a paper edge moving along the feed path and an image printed thereon. The method includes the following steps. First, moving the printed sheet past at least one pair of optical sensors to determine a first skew of the paper edge with respect to a first fixed reference and a second skew of the image with respect to a second fixed reference. Then, combining the first skew and the second skew to determine the total skew between the paper edge and the image. Finally, correcting the total skew using the first skew and the second skew information.

According to other aspects illustrated herein, there is provided a method for controlling the lateral positioning of a printed sheet along a direction perpendicular to the feed path of a print making device, with the printed sheet being a sheet of paper with a side edge moving along the feed path and an image printed thereon. The method includes the following steps. First, moving the printed sheet past at least one optical sensor to determine an actual distance by finding a location of the side edge and a portion of the actual image located closest to the side edge using the at least one optical sensor. Then, determining an ideal distance between the side edge and a portion of an ideal image located closest to the side edge by finding the location of the side edge and a portion of the ideal image located closest to the side edge using the at least one optical sensor. Next, comparing the actual distance and the ideal distance to determine the lateral error. Finally, correcting the lateral error using the actual distance and the ideal distance information.

According to other aspects illustrated herein, there is provided a system for use with a print making device to measure and control the angular orientation of a printed sheet. The system includes at least one optical sensor configured to determine a paper edge and an image edge closest to the paper edge; and a control module configured to determine total skew between the paper edge and an angular orientation of the image edge. The print making device moves the printed sheet past at least one pair of optical sensors to determine a first skew of the paper edge with respect to a first fixed reference and a second skew of the image with respect to a second fixed reference. The control module determines the total skew between the paper edge and the image by combining the first skew and the second skew and correcting the total skew using the first skew and the second skew information.

According to further aspects illustrated herein, there is provided a system for use with a print making device to measure and control the angular orientation of a printed sheet. The system includes at least one optical sensor, wherein the at least one optical sensor is configured to determine an actual distance and an ideal distance. The actual distance is determined by finding the distance between a side edge and a portion of an actual image located closest to the side edge, and the ideal distance is determined by finding the distances between the side edge and a portion of an ideal image edge closest to the side edge. The system further includes a control module configured to determine a lateral error between the ideal image and the actual image by comparing the actual distance and the ideal distance. The print making device moves the printed sheet past at least one pair of optical sensors to determine a lateral error of the side edge with respect to the actual distance and the ideal distance. Then, the control module adjusts the lateral positioning of the printed sheet along the feed path.

Additional features and advantages will be readily apparent from the following detailed description, the accompanying drawings and the claims. It is to be understood, however, that the drawings are designed as an illustration only and not as a definition of the limits of the disclosure.

BRIEF DESCRIPTION OF THE DRAWINGS

Like reference symbols in the various drawings indicate like elements.

DETAILED DESCRIPTION

Figure 1:
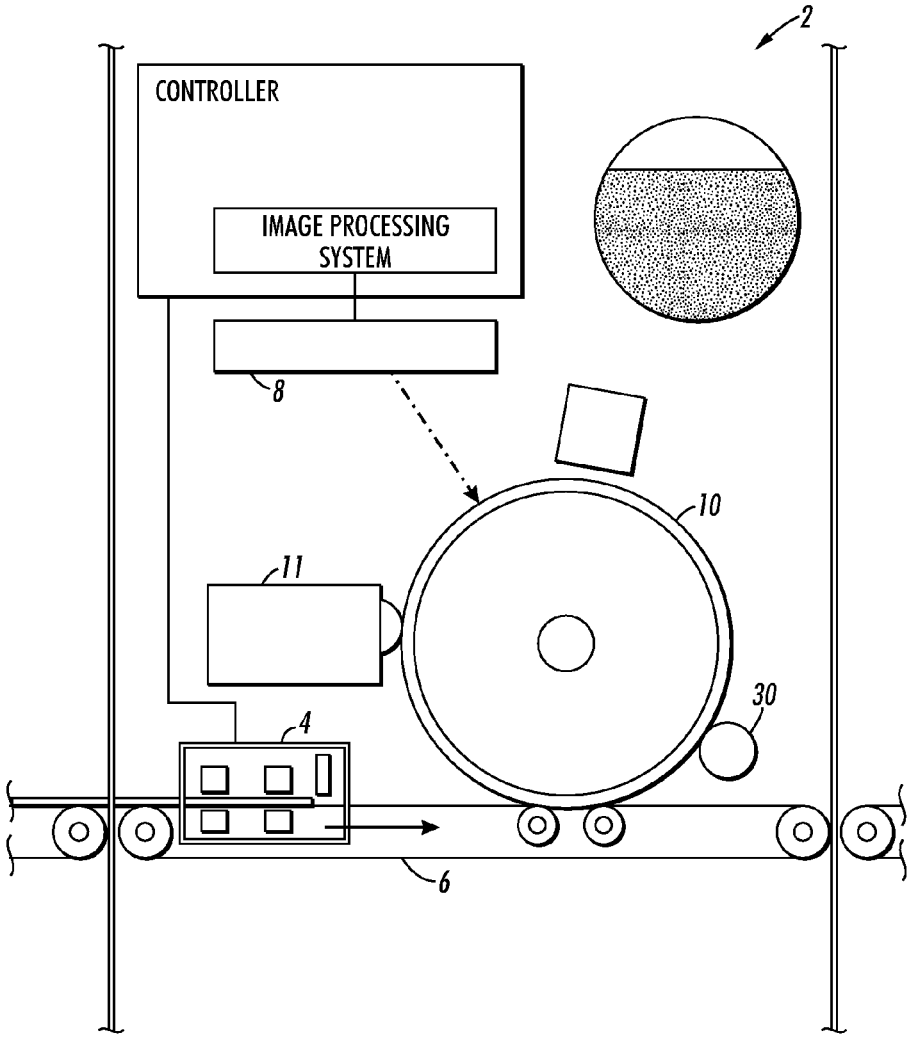
FIG. 1 shows an elevational view of a module for a xerographic printer including a sheet sensing system.

The methods and systems disclosed herein use optical sensors to determine the paper edge and the image edge to control the sheet's angular orientation and/or lateral positioning during printing.

As used herein, the phrase "print making device" encompasses any apparatus, such as a digital copier, a bookmaking machine, a facsimile machine, and a multi-function machine, which performs a printing outputting function for any purpose. Examples of marking technologies include xerographic, inkjet, and offset marking.

As used herein, the phrase "printed sheet" or "sheet" encompasses, for example, one or more of a usually flimsy physical sheet of paper, heavy media paper, coated papers, transparencies, parchment, film, fabric, plastic, or other suitable physical print media substrate on which information can be reproduced.

As used herein, the phrase "feed path" encompasses any apparatus for separating and/or conveying one or more sheets into a substrate conveyance path inside a print making device.

As used herein, the phrase "paper edge" refers to one or more of the edges of a sheet that a sensor may monitor as the sheet moves along the substrate conveyance path.

As used herein, the phrase "lead edge" refers to the paper edge of a sheet that first advances along the substrate conveyance path. The lead edge may be a long edge or a short edge of the sheet depending on the desired orientation of the sheet as the sheet moves along the substrate conveyance path.

As used herein, the phrase "side edge" refers to the paper edge of a sheet adjacent to a lead edge.

As used herein, the term "angular orientation" refers to an angular error in the placement of an image printed onto a printed sheet. The terms "skew" and "angular orientation" are used herein interchangeably.

As used herein, "optical sensor" refers to a device that responds to a physical stimulus and transmits a resulting impulse for the measurement and/or operation of controls. Specifically, optical sensors use light, but the use of the term optical sensor herein may also refer to a sensor that measures motion, heat, sound, and magnetism. Such sensors may be used for detecting and/or measuring characteristics of a sheet, such as speed, orientation, process or cross-process position and even the size of the sheet.

As used herein, the phrase "fixed reference" refers the alignment and configuration of the sensor, which points at a non-changing location to where the sensor collects information. The reference is a fixed reference because the sensor will only detect activity at the configured location. For example, a fixed reference may be the edge of a paper tray and the sensor may detect when a sheet leaves the tray.

As used herein, the phrase "ideal image" refers to a predetermined angular orientation and positioning for an image on a sheet. The ideal image is determined based upon how the image was laid out in the original document that needs to be printed or copied on a sheet.

As used herein, the phrase "actual image" refers to a measured angular orientation and positioning of an image on a printed sheet. The actual image is determined using various methods including, for example, manual measurement.

As used herein, the phrase "ideal distance" refers to a predetermined distance between an image edge and a paper edge of a sheet.

As used herein, the phrase "actual distance" refers to a measured positioning between an image edge and a paper edge of a sheet.

FIG. 1 provides an exemplary module 2 of a print making device including a sheet sensing system 4 for use with the methods provided herein. The sheet sensing system 4 is disposed to detect the position of a sheet being received in the module 2 and riding on a transport 6. The sheet sensing system 4 is configured to detect anomalies in the position of the sheet received on transport 6 and output what can be called an "error signal" related to any anomaly. This error signal in turn can be used to influence an exposure device 8 for the printing of subsequent sheets.

After the exposure device 8 creates a corresponding portion of an electrostatic image on the photoreceptor 10, the image may be developed at the development unit 11 and transferred to the printed sheet at the transfer zone. At that point, the same sheet sensing system 4 or an additional sensing system after the photoreceptor 10 looks at a paper edge or a particular area of the printed sheet to detect an anomaly on the printed sheet. The sheet sensing system 4 then may use any or all error signals created by the anomaly to adjust subsequent sheets by iteratively correcting the subsequent sheet for any and all error signals prior to printing the subsequent sheets.

Figure 2:
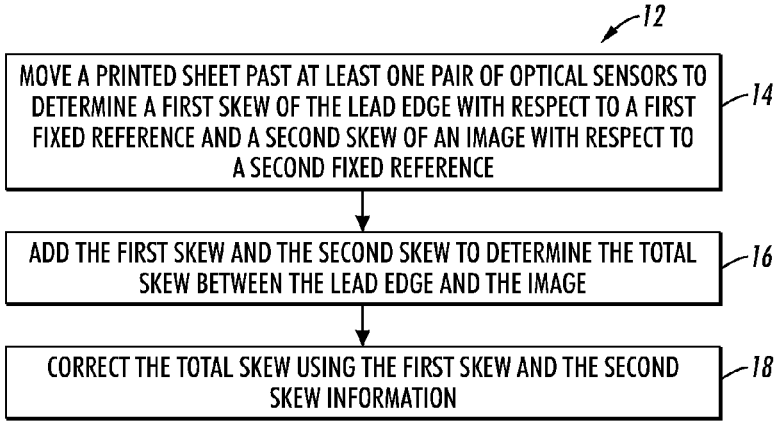
FIG. 2 illustrates a method of using at least one pair of optical sensors to determine the skew between an image and a sheet of paper.

FIG. 2 provides a method 12 for controlling an angular orientation of a printed sheet along a feed path of a print making device by determining a skew error. The printed sheet being a sheet of paper with a paper edge moving along the feed path and an image printed thereon. The method 12 includes a first step 14, where the printed sheet is moved past at least one pair of optical sensors to determine a first skew of the paper edge with respect to a first fixed reference and a second skew of an image with respect to the same or a second fixed reference.

In step 16, the first skew and the second skew are combined to determine the total skew between the paper edge and the image. Using this knowledge, suitable adjusting and/or positioning elements can be manipulated, in step 18, to correct the skew between the paper and the image for subsequent prints. For example, changes to subsequent prints may include changing the reference between the image and the sheet and changing the target skew for a media registration device.

Figure 3:
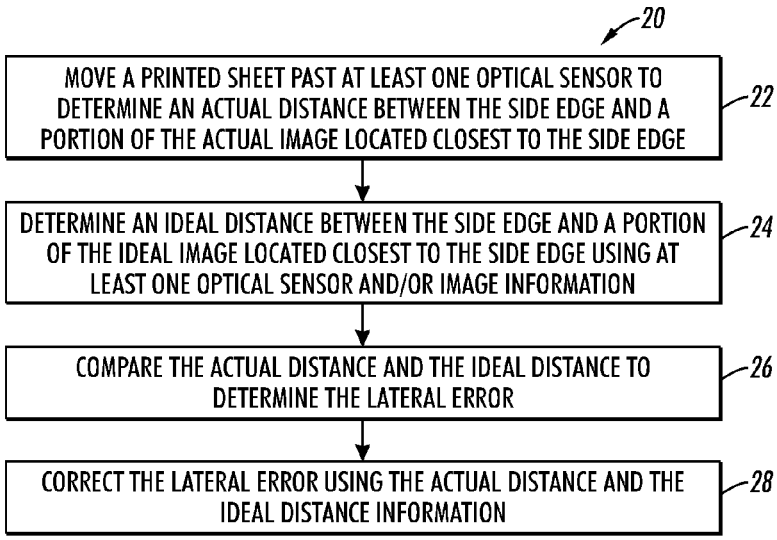
FIG. 3 illustrates a variation of the method of FIG. 2 for using at least one optical sensor to determine the lateral error on a print making device.

FIG. 3 provides a method 20, which is a variation of the method 12 of FIG. 2, for controlling the positioning of a printed sheet perpendicular to the feed path of a print making device by determining a lateral error. The printed sheet being a sheet of paper with a side edge moving along the feed path and an image printed thereon. The method 20 of FIG. 3 includes a first step 22, where the printed sheet is moved past at least one pair of optical sensors to determine an actual distance between the side edge and a portion of an actual image located closest to the side edge. The actual distance is determined by finding the location of the side edge and the portion of the actual image edge located closest to the side edge using the optical sensor.

Next, in step 24, an ideal distance between the side edge and a portion of an ideal image located closest to the side edge is determined by finding the location of the side edge and a portion of the ideal image located closest to the side edge using the optical sensor and/or known image information and taking the difference between the location of the side edge and the portion of the ideal image located closest to the side edge. After that, step 26 compares the actual distance and the ideal distance to determine the lateral error. Then, in step 28, the lateral error is corrected using the actual distance and ideal distance information to manipulate adjusting and/or positioning elements between the sheet and the image.

Figure 4:
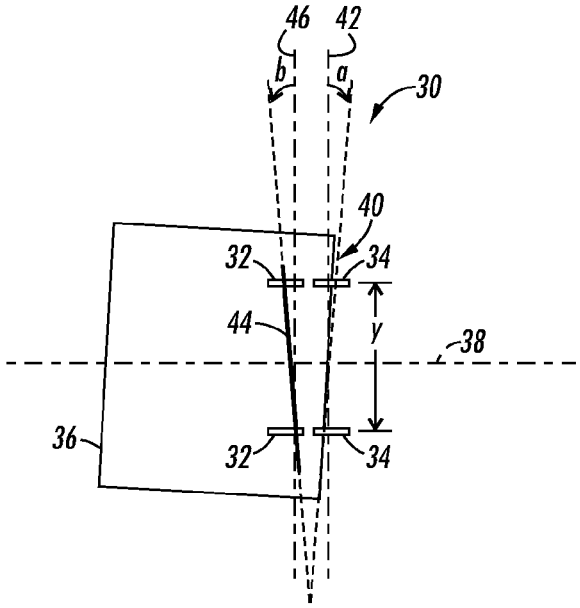
FIG. 4 illustrates a sheet sensing system including two pairs of optical sensors capable of being used to determine the skew between an image and a sheet of paper.
Figure 5:
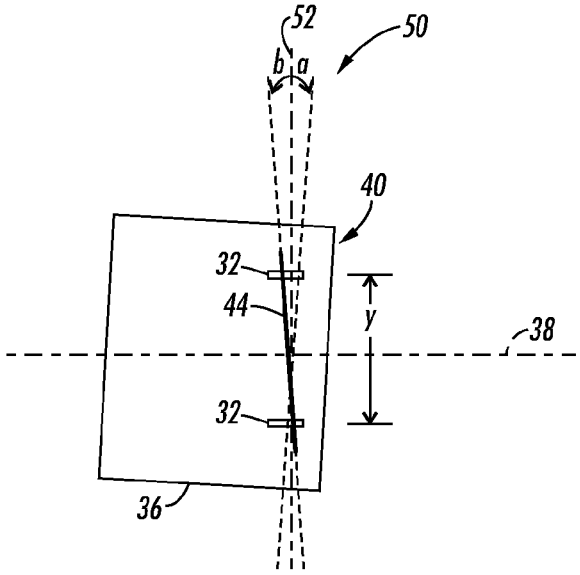
FIG. 5 illustrates a sheet sensing system including one pair of optical sensors capable of being used to determine the skew between an image and a sheet of paper.

Referring to FIGS. 4-5, exemplary sheet sensing systems are shown for use with the method 10 for determining a skew error of an image on a printed sheet in a print making device. The systems work in conjunction with modules, components, and/or other elements of the print making device.

FIG. 4 specifically refers to a double sensor skew system 30 for use with the method 10 that includes two pairs of optical sensors 32, 34 to measure an angular orientation of a printed sheet 36 and an image 44 along a feed path 38 of a print making device. The printed sheet 36 may be a sheet of paper with a lead edge 40 moving along the feed path 38 and the image 44 printed thereon. The system 30 uses the feed path to move the printed sheet 36 past the two pairs of sensors 32, 34 to determine a first skew a of the lead edge 40 with respect to a first fixed reference 42 and a second skew b of the image 44 with respect to a second fixed reference 46.

Then, the system 30 combines the first skew a and the second skew b to determine a total skew between the lead edge 40 and the image 44. After that, the system 30 may correct errors in the total skew using the first skew a and the second skew b information to adjust the angular orientation of the printed sheet 36 along the feed path 38 or by making adjustments to the print making device.

FIG. 5 refers to a single sensor skew system 50 similar to the system 30 of FIG. 4, but FIG. 5 includes one pair of optical sensors 32 to control an angular orientation of a printed sheet 36 along a feed path 38 of a print making device. Since the system 50 includes one pair of optical sensors 32, both the first skew a of the lead edge 40 and the second skew b of the image 44 are determined with respect to a single fixed reference 52.

With respect to other aspects described above, one skilled in the art will appreciate that the method 10 may use the systems 30 and 50 in a similar manner. For example, FIGS. 4 and 5 show the lead edge 40 as the long edge of the sheet, but the sheet could also be rotated so that the side edge 41 or the short edge of the sheet is the lead edge 40.

The method 12, which may be applied to above systems 30 and 50, uses the nominal velocity of the printed sheet 36 and the distance between the first pair of optical sensors 32 and/or the second pair of optical sensors 34 to determine the total skew between the paper edge 40 and the image 44. The nominal velocity is the known velocity at which the printed sheet 36 is being driven. The nominal velocity may be based on the motor voltage supplied or read by the print making device using an encoder. The total skew may be corrected by adjusting the angular orientation of the printed sheet 36 relative to the feed path 38 and/or by making adjustments to the print making device.

Figure 6:
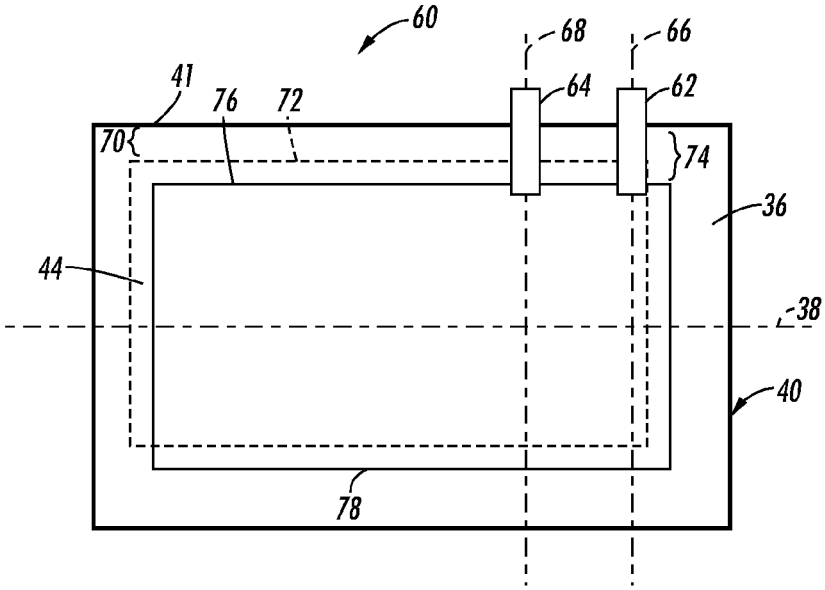
FIG. 6 illustrates a sheet sensing system including two optical sensors capable of being used to determine the lateral error on a print making device.
Figure 7:
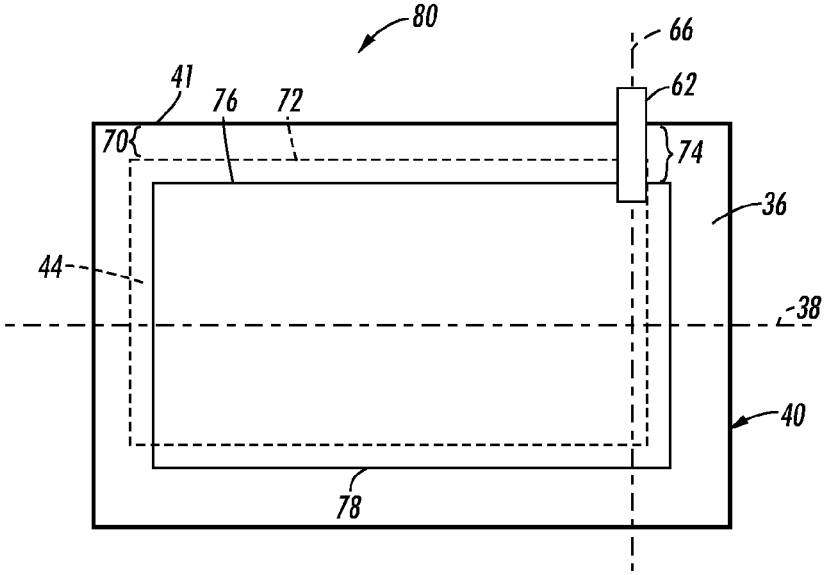
FIG. 7 illustrates a sheet sensing system including one optical sensor capable of being used to determine the lateral error on a print making device.

Referring to FIGS. 6-7, exemplary sheet sensing systems are shown for use with the method 20 for determining a lateral error of an image on a printed sheet in a print making device.

FIG. 6 specifically refers to a double sensor lateral system 60 for use with the method 20 that includes two optical sensors 62, 64 to measure the lateral positioning of a printed sheet 36 along a feed path 38 of a print making device. The printed sheet 36 may be a sheet of paper with a lead edge 40 moving along the feed path 38 and the image 44 printed thereon. The system 60 uses the feed path 38 to move the printed sheet 36 past the two sensors 62, 64 to determine an actual distance 70 between the side edge 41 and a portion 72 of the actual image 44 located closest to the side edge 41. The actual distance 70 is determined by finding the location of the side edge 41 and the portion 72 of the actual image 44 located closest to the side edge 41 using the optical sensors 62, 64 and taking the difference between the location of the side edge 41 and the portion 72 of the actual image 44 located closest to the side edge 41.

Next, an ideal distance 74 between the side edge 41 and a portion 76 of an ideal image 78 located closest to the side edge 41 is determined by finding the location of the side edge 41 and a portion 76 of the ideal image 78 located closest to the side edge 41 using the optical sensors 62, 64 and taking the difference between the location of the side edge 41 and the portion 76 of the ideal image 78 located closest to the side edge 41. The ideal distance may also be determined using known image information. Then, the control module in the system 60 compares the actual distance 70 and the ideal distance 74 to determine the lateral error between the ideal image and the actual image. After that, the system 60 may correct the lateral error using the actual distance 70 and the ideal distance 74 information to adjust the lateral positioning of the printed sheet 36 along the lateral direction of the feed path 38.

FIG. 7 refers to a single sensor lateral system 80 similar to the system 60 of FIG. 6, but FIG. 7 includes one optical sensor 62 to measure the lateral positioning of a printed sheet 36 along a feed path 38 of the print making device. Since the system 80 includes one optical sensor 62, both the actual distance 70 and the ideal distance 74 are determined with respect to a single fixed reference 66. One skilled in the art will appreciate that the method 20 may use the systems 60 and 80 in a similar manner.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. An inline method for measuring and controlling angular orientation of sheets along a feed path of a print making device including a printed sheet, the printed sheet being a sheet of paper with a paper edge moving along the feed path and a first image printed thereon, comprising the steps of:

moving, via a moving unit, the printed sheet past at least one pair of optical sensors to determine, via a computing device, a first skew of the paper edge with respect to a first fixed reference;

moving, via the moving unit, the printed sheet past said at least one pair of optical sensors to determine, via the computing device, a second skew of the first image with respect to a second fixed reference;

determining, via the computing device, a total skew between the paper edge and the first image using a combination of said first skew and said second skew; and correcting for the total skew for subsequent printing by adjusting the angular orientation of subsequent sheets along the feed path.

2. The method of claim 1, wherein said at least one pair of optical sensors includes a single pair of optical sensors and said single pair of optical sensors determines said first skew and said second skew.

3. The method of claim 2, wherein said first fixed reference and said second fixed reference are located at the same position.

4. The method of claim 1, wherein said at least one pair of optical sensors includes a first pair of optical sensors and a second pair of optical sensors.

5. The method of claim 4, wherein said first pair of optical sensors determines a first skew of the paper edge with respect to a first fixed reference and said second pair of optical sensors determines a second skew of the image with respect to a second fixed reference.

6. The method of claim 1, wherein the paper edge moving along the feed path is a lead edge.

7. The method of claim 1, wherein said first skew and said second skew information is used to adjust the angular orientation of the printed sheet along the feed path.

8. The method of claim 1, wherein said first skew and said second skew information is manipulated to make adjustments to the print making device.

9. A system for use with a print making device to inline measure and control angular orientation of sheets along a feed path in the print making device, including a printed sheet with a paper edge moving along the feed path and a first image printed thereon, the system comprising:

at least one pair of optical sensors, wherein said at least one pair of optical sensors is configured to determine said paper edge and an image edge of said first image closest to said paper edge; and a control module configured to determine a total skew between said paper edge and an angular orientation of said image edge, wherein the print making device moves the printed sheet past said at least one pair of optical sensors to determine a first skew of said paper edge with respect to a first fixed reference and the print making device moves the printed sheet past said at least one pair of optical sensors to determine a second skew of said image edge with respect to a second fixed reference; and said control module determines a total skew between said paper edge and said image edge using a combination of said first skew and said second skew, and corrects for the total skew for subsequent printing by adjusting the angular orientation of subsequent sheets along the feed path.

10. The system of claim 9, wherein said at least one pair of optical sensors includes a single pair of optical sensors and said single pair of optical sensors determine said first skew and said second skew.

11. The system of claim 10, wherein said first fixed reference and said second fixed reference are located at the same position.

12. The system of claim 9, wherein said at least one pair of optical sensors includes a first pair of optical sensors and a second pair of optical sensors, said first pair of optical sensors determines a first skew of said paper edge with respect to a first fixed reference and said second pair of optical sensors determines a second skew of the image with respect to a second fixed reference.

13. The system of claim 9, wherein said paper edge moving along the feed path is a lead edge.

14. The system of claim 9, wherein said first skew and said second skew information is used to adjust the angular orientation of the printed sheet along the feed path.

15. The system of claim 9, wherein said first skew and said second skew information is manipulated to make adjustments to the print making device.

* * * * *